US010356512B1

(12) United States Patent
Peace, Jr.

(10) Patent No.: US 10,356,512 B1
(45) Date of Patent: Jul. 16, 2019

(54) UNIFIED WAVEFRONT FULL-RANGE WAVEGUIDE FOR A LOUDSPEAKER

(71) Applicant: Harman International Industries, Incorporated, Stamford, CT (US)

(72) Inventor: Paul Wayne Peace, Jr., Port Hueneme, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/869,719

(22) Filed: Jan. 12, 2018

(51) Int. Cl.

| | |
|---|---|
| ***H04R 25/00*** | (2006.01) |
| ***H04R 1/30*** | (2006.01) |
| ***H04R 1/02*** | (2006.01) |
| ***H04R 1/40*** | (2006.01) |
| ***H04R 3/14*** | (2006.01) |
| ***H04R 1/24*** | (2006.01) |

(52) U.S. Cl.
CPC ..... *H04R 1/30* (2013.01); *H04R 1/025* (2013.01); *H04R 1/24* (2013.01); *H04R 1/403* (2013.01); *H04R 3/14* (2013.01)

(58) Field of Classification Search
CPC . H04R 1/30; H04R 1/025; H04R 1/24; H04R 1/403; H04R 3/14
USPC ..... 381/340
See application file for complete search history.

(56) References Cited

U.S. PATENT DOCUMENTS 1,801,521 A * 4/1931 Milnor ..... G10K 11/025 181/185
3,715,008 A * 2/1973 Lover ..... H04R 1/227 181/147
4,344,504 A * 8/1982 Howze ..... G10K 11/025 181/187
6,118,883 A * 9/2000 Rocha ..... H04R 1/24 181/144
6,394,223 B1 * 5/2002 Lehman ..... H04R 1/345 181/152

(Continued)

FOREIGN PATENT DOCUMENTS

| | | |
|---|---|---|
| EP | 3041262 A1 | 7/2016 |
| WO | 9419915 A1 | 9/1994 |

OTHER PUBLICATIONS

European Search Report for European Application No. EP19151072.6, dated May 29, 2019, 10 pages.

(Continued)

*Primary Examiner* — Phylesha Dabney
(74) *Attorney, Agent, or Firm* — Brooks Kushman P.C.

(57) ABSTRACT

A loudspeaker may include a full-range waveguide for creating a unified wavefront. The waveguide may include a plurality of entrances, which may be positioned at a first axial end. The waveguide may include a mouth disposed at a second axial end opposite the plurality of entrances. A contoured surface extending between the entrance and the mouth defines a cavity within the waveguide. The contoured surface may include a first pair of walls positioned opposite one another and a second pair of walls positioned opposite one another. The waveguide may include at least one integrator disposed in the cavity between two adjacent entrances. Each integrator may extend transversely between the first pair of walls and may taper towards the mouth to form a pointed edge extending between the first pair of walls. A pair of integrator surfaces each include a solid portion and a perforated portion.

20 Claims, 3 Drawing Sheets

(56) References Cited

U.S. PATENT DOCUMENTS

| | | | | |
|---|---|---|---|---|
| 7,298,860 | B2 * | 11/2007 | Engebretson | H04R 1/026 381/335 |
| 8,607,922 | B1 * | 12/2013 | Werner | H04R 1/26 181/152 |
| 9,571,923 | B2 * | 2/2017 | Spillmann | H04R 1/2803 |
| 9,860,633 | B2 * | 1/2018 | Button | H04R 1/025 |
| 9,894,433 | B2 * | 2/2018 | Bridge | H04R 1/345 |
| 2002/0014369 | A1 * | 2/2002 | Engebretson | H04R 1/26 181/199 |
| 2002/0106097 | A1 * | 8/2002 | Danley | H04R 1/26 381/345 |
| 2003/0188920 | A1 * | 10/2003 | Brawley, Jr. | G10K 11/30 181/176 |
| 2004/0131217 | A1 * | 7/2004 | Opie | H04R 1/26 381/336 |
| 2004/0216948 | A1 * | 11/2004 | Meyer | H04R 1/30 181/188 |
| 2014/0263600 | A1 | 9/2014 | Valencia | |
| 2019/0020937 | A1 * | 1/2019 | Peace, Jr. | H04R 1/22 |
| 2019/0037306 | A1 * | 1/2019 | Peace, Jr. | H04R 5/02 |

OTHER PUBLICATIONS

Jean Hiraga, Les haut-parleurs, Nov. 2, 2000, Dunod, Paris, XP055075637, p. 294, 1 page.

Jean Hiraga, Les haut-parleurs, Nov. 2, 2011, Dunod, Paris, XP055590427, ISBN: 978-2-10-005268-4, p. 296, 1 page.

* cited by examiner

UNIFIED WAVEFRONT FULL-RANGE WAVEGUIDE FOR A LOUDSPEAKER

TECHNICAL FIELD

The present disclosure relates to a waveguide for a loudspeaker for generating a unified wavefront.

BACKGROUND

A major design criteria for loudspeakers is to create a consistent wavefront at all frequencies. A consistent wavefront at all frequencies is the foundation of uniform directivity, power response, and smooth cross-over transitions from the independent transducers needed to make up a full-range loudspeaker. Current loudspeaker implementations include numerous approaches to achieve a consistent wavefront at all frequencies. The traditional approach is to include discrete waveguides for high-frequency (HF), mid-frequency (MF), and low-frequency (LF) drivers. Another approach includes the coaxial loading of drivers where one element is placed in front of another element and can include one or two waveguides. These approaches are all trying to get different acoustical sources as close as geometrically possible to improve crossover directivity behavior, as well as producing a high driver/source density that enables greater output sound pressure level within a smaller package.

SUMMARY

A loudspeaker may include a horn or a waveguide, which may define the coverage pattern of the loudspeaker in one or more planes. As used herein, the terms "coverage pattern" or "pattern" of sound waves refers to at least one of, or both of, the directivity and propagation behavior of sound waves radiating from a loudspeaker. The waveguide may include a plurality of entrances, which may be positioned at a first axial end of the horn or waveguide. The entrances may be positioned on an entrance plane that is perpendicular to a longitudinal axis of the waveguide. The longitudinal axis may be a line that is perpendicular to the entrance plane and intersects the entrance plane at the center of the waveguide (e.g., in the center of a middle entrance for a waveguide having an odd number of entrances). The entrances may be configured to receive a driver or transducer. The waveguide may include a mouth disposed at a second axial end of the waveguide opposite the plurality of entrances.

The waveguide may include a contoured surface extending between the entrance and the mouth. The contoured surface may be an inner surface defining a cavity within the waveguide. The contoured surface may include, for example, a frustoconical surface or a plurality of walls arranged relative to one another to from the cavity. The waveguide may include a plurality of throats corresponding to the plurality of entrances. Each throat may extend between a corresponding entrance and a throat opening. Each throat may extend from the entrance to the throat opening to couple the contoured surface to the entrance. Each throat may be configured as a tubular member defined by one or more walls. In one example, the cross-sectional area of each throat transverse to the longitudinal axis of the waveguide may expand along the longitudinal axis of the waveguide. For example, the cross-sectional area of the throat may expand exponentially. In other examples, the cross-sectional area of each throat may remain substantially constant, contract, or any combination thereof. The terms "horn" and "waveguide" may be used interchangeably herein, and are defined to include any form of mechanism or device having a plurality of entrances and a mouth that can be placed in the vicinity of a loudspeaker enclosure to affect or modify the directivity or pattern of at least a portion of audible sound waves produced by the loudspeaker.

In one example, a bi-radial waveguide may at least partially define the coverage angle of sound waves emitted by a loudspeaker in multiple planes (i.e., multiple design planes). The bi-radial waveguide may include a first pair of walls positioned opposite one another and a second pair of walls positioned opposite one another. The first pair of walls may be mirror images of one another. The second pair of walls may be mirror images of one another. The first pair of walls and the second pair of walls may be arranged relative to one another to form the contoured surface and the cavity of the bi-radial horn. The waveguide may include at least one integrator disposed in the cavity between two adjacent entrances. Each integrator may extend transversely between the first pair of walls and may extend longitudinally from a location near the throat opening toward the second axial end. Each integrator may taper towards the mouth to form a pointed edge that extends between the first pair of walls. A pair of integrator surfaces, angled with respect to one another, may join at the pointed edge to form the integrator.

In another example, an elliptical waveguide may define the coverage pattern of a loudspeaker in one plane (i.e., the design plane). The elliptical waveguide may include a contoured surface having a generally frustoconical shape. A cross section of the contoured surface taken transverse to the longitudinal axis of the waveguide may have an elliptical shape. The elliptical waveguide may lack a throat. In other words, the throat may be omitted, and the first axial end of the contoured surface may be positioned at the entrance of the waveguide.

DETAILED DESCRIPTION

Figure 1:
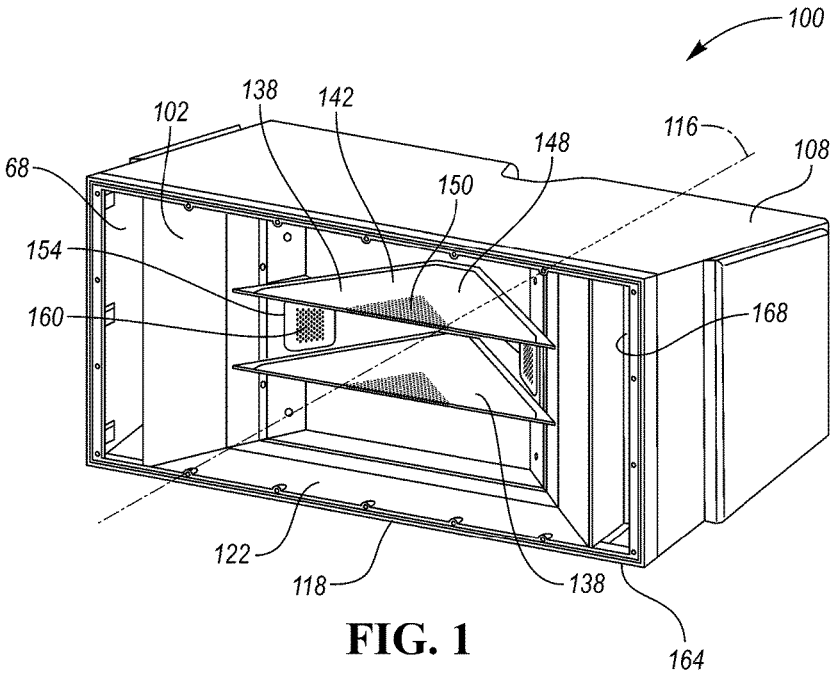
FIG. 1 is a perspective view of a loudspeaker, in accordance with one or more embodiments of the present disclosure.
Figure 2:
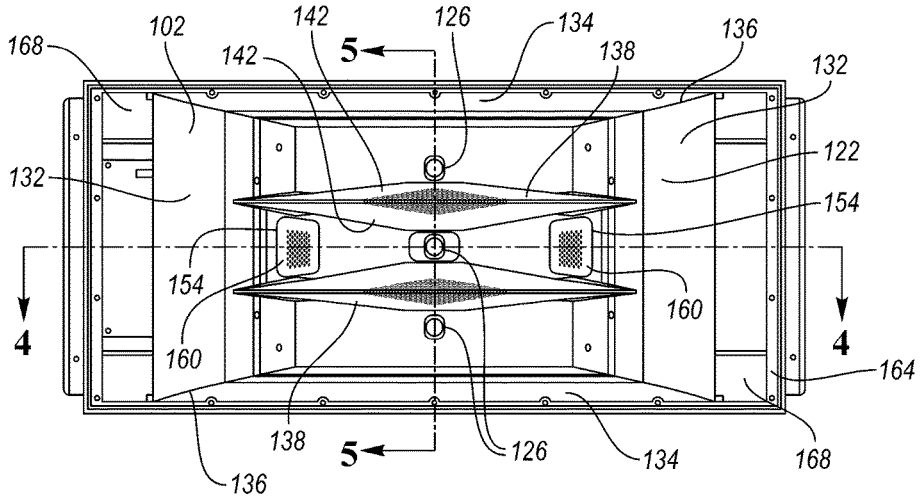
FIG. 2 is a front view of the loudspeaker in FIG. 1.
Figure 3:
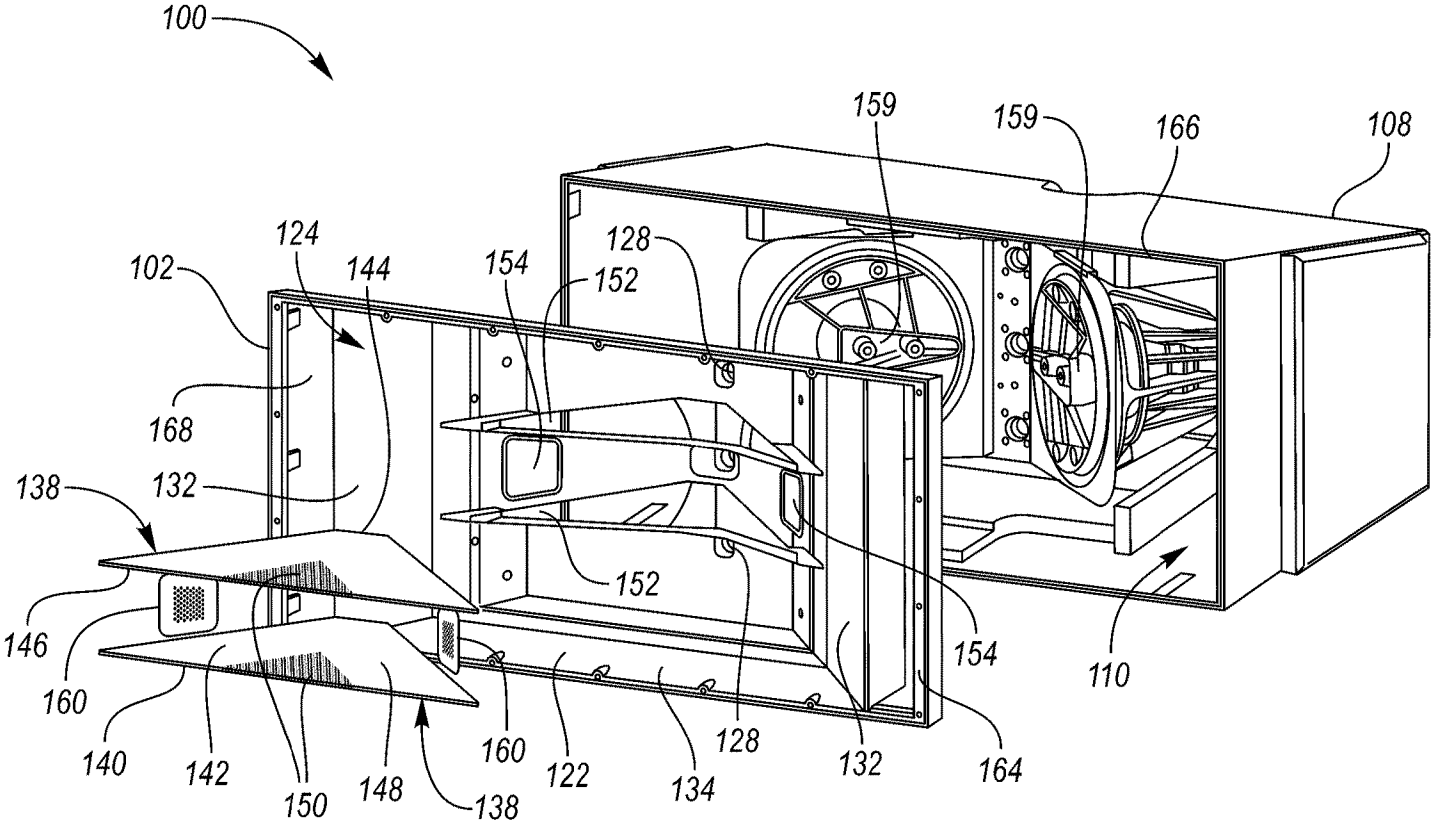
FIG. 3 is a section view of the loudspeaker in FIG. 1 taken along section lines 3-3.
Figure 4:
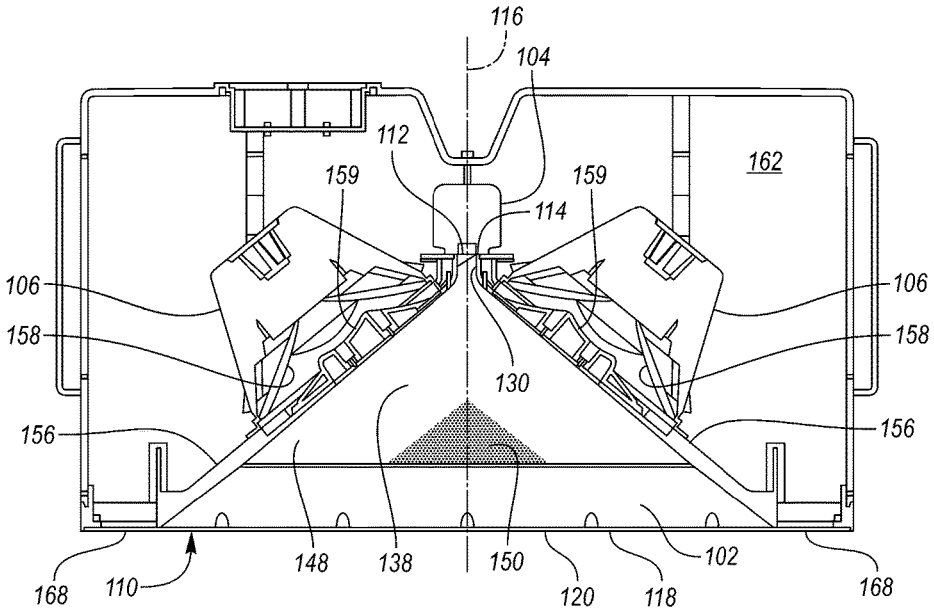
FIG. 4 is a section view of the loudspeaker in FIG. 1 taken along section lines 4-4 in FIG. 2.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-5 illustrate one example of a loudspeaker 100 having a unitary waveguide 102, which may define the coverage angle of the loudspeaker in three or more planes. The loudspeaker may be a two-way loudspeaker having a plurality of high-frequency (HF) transducers 104 aligned along a first plane and at least one lower frequency transducer 106 disposed within a loudspeaker enclosure 108. The waveguide 102 may be mounted to the loudspeaker enclosure 108 at a loudspeaker opening 110. The lower frequency transducer 106 may be a mid-frequency (MF) transducer or a low-frequency (LF) transducer.

The waveguide 102 may include a plurality of entrances 112 positioned at a first axial end 114 of the waveguide 102. In the example shown in FIGS. 1-5, the waveguide 102 may include three entrances 112. The entrances 112 may have any geometric shape including, for example, circular, elliptical, rectangular, or the like. In the example shown in FIGS. 1-5, the entrances 112 may have a circular shape. The entrances 112 may be positioned on an entrance plane that is perpendicular to a longitudinal axis 116 of the waveguide 102. The longitudinal axis 116 may be a line that is perpendicular to the entrance plane and intersects the entrance plane at the center of the waveguide (e.g., in the center of a middle entrance for a waveguide having an odd number of entrances). Each entrance 112 may be configured to receive a HF transducer 104. Like the plurality of HF transducers 104, each entrance may be aligned along a first plane parallel to the longitudinal axis 116.

The waveguide 102 may include a mouth 118 disposed at a second axial end 120 of the waveguide opposite the entrances 112. The mouth 118 may have any geometric shape. The mouth 118 may be planar or non-planar. For example, the mouth 118 may be disposed on a plane that is substantially parallel to the entrance plane. Alternatively, the mouth 118 may be curved. In the example shown in FIGS. 1-5, the mouth 118 may have a rectangular shape. In other examples, the entrances 112 and the mouth 118 may have any other shape. The waveguide 102 may include a contoured surface 122 extending between the entrances 112 and the mouth 118. The contoured surface 122 defines a cavity 124 within the waveguide 102. The contoured surface 122 may include, for example, a frustoconical surface or a plurality of walls arranged relative to one another to form the cavity.

The waveguide 102 may include a plurality of throats 126, with each throat extending between a corresponding entrance 112 and the contoured surface 122 to couple the contoured surface 122 and the entrances 122 to one another. Each throat 126 may include a throat opening 128 opposite the entrance. In the example shown in FIGS. 1-5, the contoured surface 122 may extend longitudinally from the throat opening 128 to the second axial end 120 positioned near the mouth 118. In one example, the transition between each throat 126 and the contoured surface 122 may be smooth and/or continuous. In other examples, the transition between each throat 126 and the contoured surface 122 may be discontinuous and/or abrupt (e.g., a stepped transition). The throats 126 may be configured to fill the gap between the throat opening 128 and the entrances 112. In this manner, the geometry (e.g., the size and/or the shape) of the contoured surface 122 may be independent of the geometry of the entrances 112, and the geometry of the throats 126 may be dependent on the geometry of the contoured surface 122 and/or the geometry of the entrances 112.

Each throat 126 may include a wall defining 130 a tubular segment extending between the entrance 112 and the contoured surface 122. In one example, the wall 130 of a throat 126 may be substantially perpendicular to the entrance plane. In other examples, the wall 130 of a throat may be positioned at any angle relative to the entrance plane such that the passageway extending longitudinally within the tubular segment may have a tapered cross section. A longitudinal axis of each throat may be parallel with the longitudinal axis 116 of the waveguide 102. In the example shown in FIGS. 1-5, the longitudinal axis of a central throat may be in line with the longitudinal axis 116 of the waveguide 102. A depth of each throat 126 may be defined as the longitudinal distance between the entrance 112 and the throat opening 128 of the contoured surface 122.

The waveguide 102 may include a plurality of walls that collectively define the contoured surface 122. For example, the waveguide 102 may include four walls as shown in FIGS. 1-5. The waveguide 102 may include a first pair of walls 132 positioned opposite one another and a second pair of walls 134 positioned opposite one another. The first pair of walls 132 may be mirror images of one another. Additionally, or alternatively, the second pair of walls 134 may be mirror images of one another. In other examples, the waveguide 102 may include any number of walls (e.g., three, five, or more) that collectively form the contoured surface 122. The first pair of walls 132 and the second pair of walls 134 may be arranged relative to one another to form the contoured surface 122 of the waveguide 102. To that end, each wall 132 may be joined to an adjacent wall 134 at a joint 136. The joint 136 may extend longitudinally between an entrance 112 and the mouth 118 of the waveguide 102. For example, each joint 136 may extend longitudinally from the throat opening 128 to the mouth 118. The walls 132 and 134 may be formed as a unitary structure or formed separately and joined to one another to form the contoured surface 122. The walls 132 and 134 may flare outward as shown in FIGS. 1-5. In other examples, the walls may extend straight (e.g., planar), curve inward, or have any other desired configuration.

Figure 5:
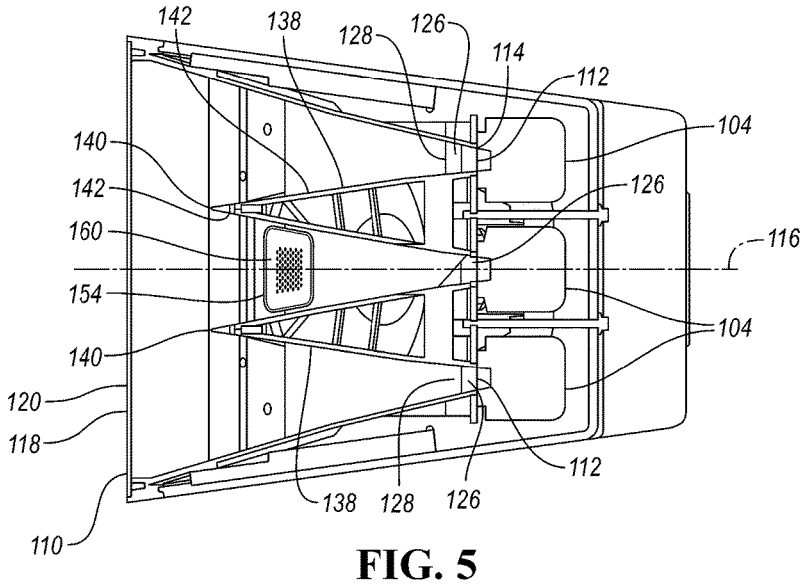
FIG. 5 is an exploded view of the loudspeaker in FIG. 1.

The waveguide 102 may include at least one integrator 138 disposed in the cavity 124 between two adjacent entrances 112. In the example shown in FIGS. 1-5, the waveguide 102 may include two integrators 138. Each integrator 138 may extend transversely between the first pair of walls 132 and may extend longitudinally from a location near the throat opening 128 toward the second axial end 120. Each integrator 138 may taper towards the mouth 118 to form a pointed edge 140 that extends between the first pair of walls 132. The pointed edge 140 may be linear. A pair of integrator surfaces 142, angled with respect to one another, may join at the pointed edge 140 to form the integrator 138. The integrator surfaces 142 may be relatively flat. Each integrator surface 142 may have a trapezoidal shape with a proximal base 144 being smaller than a distal base 146. The integrator surfaces 142 may intersect at their respective distal bases 146 to form the pointed edge 140. FIG. 5 shows a sectional view of the loudspeaker 100 taken along sections lines 5-5 (i.e., parallel to the longitudinal axis 116 of the waveguide through the center of each entrance 112). The sectional view of the loudspeaker 100 illustrates each integrator 138 as having a triangular cross-section, with the widest portion nearest adjacent throats 126. As shown in FIG. 5, each integrator 138 tapers in the direction of the mouth 118 with the integrator surfaces 142 joining at the pointed edge 140.

The integrators 138 may be metal or plastic. Each integrator surface 142 may include a solid portion 148 and a perforated portion 150. The solid portion 148 may be disposed adjacent the first pair of walls 132. Accordingly, the solid portion 148 may be V-shaped, as shown in FIGS. 1-5. The perforated portion 150 may be disposed in the remaining space. In the example shown in FIGS. 1-5, the perforated portion 150 of each integrator surface 142 may be triangular-shaped with a base located along the center of the pointed edge 140 of the integrator 138. Accordingly, the perforated portion 150 may be disposed adjacent at least a portion of the pointed edge 140. In another example, the solid portion 148 and the perforated portion 150 may be separated by a straight line extending between the first pair of walls 132 to form two trapezoidal regions, with the perforated portion being nearest the mouth 118. In one example, the solid portion 148 may have an area greater than an area of the perforated portion 150. In another example, the solid portion 148 may have an area lesser than the area of the perforated portion 150. Each integrator 138 may be a separate component attached to the contoured surface 122 of the waveguide 102. Accordingly, the contoured surface 122 of the waveguide 102 may include a corresponding slot 152 along the first pair of walls 132 shaped to receive an integrator 138. Alternatively, each integrator 138 may be integrally formed in the waveguide 102. The slots 152 provides the entrance into the waveguide 102 for the lower frequency transducers 106.

Each integrator 138 provides a partition between two HF transducers 104, utilizing acoustically transparent and acoustically solid materials in such a way to allow the MF or LF energy to enter the waveguide 102 in between the HF elements. The solid portion 148 adjacent the HF transducers 104 may establish the HF wavefront before introducing the perforated portion 150. Otherwise, the waveguide 102 may depressurize immediately and won't act as a horn. Depressurization will not occur once the HF wavefront is established by the solid portion 148. The perforations in the perforated portion of each integrator 138 brings the acoustics together. The integrator 138 provides acoustic filtering. The HF transducers 104 see each integrator 138 as a horn wall, while the lower frequency transducers 106 fire into the perforated portions 150.

The waveguide 102 may include an acoustic opening 154 in each of the first pair of walls 132 overlying a lower frequency transducer 106. Each acoustic opening 154 may be disposed towards the middle of the wall 132 between integrators 138. The acoustic opening 154 may be shaped to best fit the geometry and avoid extreme aspect ratios. In the example shown in FIGS. 1-5, the acoustic opening 154 may be generally rectangular and, in particular, may be square-shaped. Each acoustic opening 154 mates the waveguide 102 to a respective lower frequency transducer 106. A back surface 156 of each wall 132 may be configured to receive a lower frequency transducer 106, such as an LF transducer or an MF transducer. Each lower frequency transducer 106 may be mounted to the back surface 156 of a wall 132 using any means known to one of ordinary skill in the art. Each lower frequency transducer 106 may include a radiating surface 158, which is excited by a voice coil (not shown) to move and create sound waves. Each acoustic opening 154 may overlay a portion of the radiating surface 158 of a corresponding lower frequency transducer 106. A phase plug 159 may be disposed between each radiating surface 158 and the waveguide 102 to minimize chamber resonances at the lower frequency transducer 106.

In the example shown in FIGS. 1-5, each acoustic opening 154 may be offset from the longitudinal axis of the lower frequency transducer 106. In another example, each acoustic opening 154 may be aligned (or coaxial) with the longitudinal axis of the lower frequency transducer 106. Each acoustic opening 154 may provide a channel through which the low-/mid-frequency energy generated by the radiating surface 158 behind the waveguide 102 is radiated. In some instances, the acoustic openings 154 may present themselves as acoustic filters. Each acoustic opening 154 may be covered by a perforated cover 160. The perforated cover 160 may be metal, plastic, or the like. The perforated cover 160 may be acoustically transparent.

The waveguide 102 may create a compression chamber 162 in a space between the back surface 156 of the waveguide and the loudspeaker enclosure 108. The size and geometry of the compression chamber 162 may determine the sound pressure level and frequency response characteristics of the lower frequency transducers 106.

The waveguide 102 may include a rim 164 around a perimeter 166 of the loudspeaker opening 110 for mounting the waveguide to the loudspeaker enclosure 108. The rim 164 may be disposed on approximately the same plane as the mouth 118. The mouth 118 may be enclosed by the rim 164. In the example shown in FIGS. 1-5, the rim 164 may extend beyond the first pair of walls 132 along the plane of the mouth 118 to define a pair of ports 168 in the loudspeaker opening 110, one on each side of the waveguide 102. The ports 168 may be rectangular, as shown. The ports 168 may allow air to flow out of the loudspeaker 100 from the compression chamber 162 to improve the low-frequency response. An acoustically transparent grill (not shown) may be attached to the front of the loudspeaker enclosure 108 covering the waveguide 102 and the ports 168.

The loudspeaker 100 and waveguide 102 of the present disclosure creates a line array of sources with a staggered geometry of the different transducers at the source end of the waveguide, nearest the entrances 112, to provide a condensed, high-density design. The combination creates a unified wavefront at the mouth 118 of the waveguide 102 and the transducers 104 and 106 can be easily configured to have exact time alignment, which is necessary for the unified wavefront. Both transducer sets (i.e., the HF transducers 104 and the lower frequency transducers 106) get loading and directivity control from the unitary waveguide. Each integrator 138 provides a partition between two HF transducers 104, utilizing acoustically transparent and acoustically solid materials in such a way to allow the MF or LF energy to enter the waveguide 102 in between the HF elements. Also, the geometry of the drivers may be such that arrays of multiple loudspeakers maintain consistent for all transducers and through crossover. Moreover, the design of the present disclosure allows different directivity angles to be established with the waveguide.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a loudspeaker enclosure;

a plurality of high-frequency transducers disposed within the loudspeaker enclosure and aligned along a first plane;

at least one lower frequency transducer disposed within the loudspeaker enclosure; and a waveguide mounted to the loudspeaker enclosure, the waveguide including:

a plurality of entrances positioned at a first axial end of the waveguide, each entrance overlaying one of the high-frequency transducers;

a mouth disposed at a second axial end of the waveguide opposite the plurality of entrances;

a first pair of walls positioned opposite one another connecting each entrance to the mouth, each lower frequency transducer configured to be mounted to one of the first pair of walls; and at least one integrator disposed between adjacent entrances and extending transversely between the first pair of walls, each integrator tapering towards the mouth to form a pointed edge in the first plane.

2. The loudspeaker of claim 1, further comprising a plurality of throats corresponding to the plurality of entrances, each throat extending between an entrance and a throat opening.

3. The loudspeaker of claim 2, further comprising a contoured surface extending between the throat opening and the mouth defining a cavity of the waveguide, the contoured surface defined by the first pair of walls position opposite one another and a second pair of walls positioned opposite one another.

4. The loudspeaker of claim 1, wherein the plurality of HF transducers includes three HF transducers and the at least one lower frequency transducer includes two lower frequency transducers.

5. The loudspeaker of claim 1, wherein each integrator has a pair of integrator surfaces angled with respect to one another, each integrator surface including a solid portion and a perforated portion.

6. The loudspeaker of claim 5, wherein the solid portion may be disposed adjacent the first pair of walls.

7. The loudspeaker of claim 5, wherein the perforated portion is adjacent at least of portion of the pointed edge.

8. The loudspeaker of claim 1, further comprising at least one acoustic opening in the first pair of walls disposed between a pair of integrators and overlaying at least a portion of a radiating surface of the at least one lower-frequency transducer.

9. The loudspeaker of claim 8, wherein a perforated cover is disposed in each acoustic opening.

10. The loudspeaker of claim 8, wherein the at least one acoustic opening is rectangular-shaped.

11. The loudspeaker of claim 1, further comprising a phase plug disposed between each lower frequency transducer and the waveguide.

12. A waveguide for use with a loudspeaker, the waveguide comprising:

a plurality of entrances positioned at a first axial end of the waveguide and aligned along a first plane, each entrance configured to overlay a high-frequency transducer;

a mouth disposed at a second axial end of the waveguide opposite the plurality of entrances;

a contoured surface extending between the entrances and the mouth defining a cavity of the waveguide, the contoured surface defined by at least a first pair of walls positioned opposite one another;

at least one integrator disposed in the cavity between adjacent entrances and extending transversely between the first pair of walls, each integrator having a pair of integrator surfaces that form a taper towards the mouth in the first plane; and at least one acoustic opening in the first pair of walls configured to overlay at least a portion of a radiating surface of a lower frequency transducer.

13. The waveguide of claim 12, wherein each integrator surface includes a solid portion and a perforated portion.

14. The waveguide of claim 12, wherein each integrator is a separate component mounted to the waveguide.

15. The waveguide of claim 14, wherein the waveguide includes at least one slot along the first pair of walls for receiving each integrator.

16. The waveguide of claim 12, wherein the at least one acoustic opening is rectangular shaped.

17. The waveguide of claim 12, wherein the waveguide includes a rim surrounding the mouth for attaching to a loudspeaker enclosure, the rim extending beyond the first pair of walls along a plane of the mouth to define a pair of ports, one on each side of the waveguide.

18. An integrator for a loudspeaker waveguide comprising:

a pair of integrator surfaces angled with respect to one another, each integrator surface being having at least a proximal base and a distal base, the integrator surfaces intersecting at their respective distal bases;

wherein each integrator surface includes a solid portion and a perforated portion.

19. The integrator of claim 18, wherein the perforated portion is triangular-shaped and adjacent at least of portion of the distal base.

20. The integrator of claim 19, wherein each integrator surface is trapezoidal-shaped with the proximal base being smaller than the distal base.

* * * * *